United States Patent [19]

Scheurecker

[11] Patent Number: 4,483,386

[45] Date of Patent: Nov. 20, 1984

[54] METHOD TO BE CARRIED OUT IN A HORIZONTAL CONTINUOUS CASTING PLANT FOR INTRODUCING A STARTER BAR HEAD OF A STARTER BAR INTO THE OPEN ENDS MOULD OF THE HORIZONTAL CONTINUOUS CASTING PLANT

[75] Inventor: Werner Scheurecker, Linz, Austria

[73] Assignee: Voest-Alpine Aktiengesellschaft, Linz, Austria

[21] Appl. No.: 423,010

[22] Filed: Sep. 24, 1982

[30] Foreign Application Priority Data

Oct. 9, 1981 [AT] Austria ..... 4343/81

[51] Int. Cl.[3] ..... B22D 11/08

[52] U.S. Cl. ..... 164/483; 164/490

[58] Field of Search ..... 164/483, 440, 490, 425, 164/426, 445, 446

[56] References Cited

FOREIGN PATENT DOCUMENTS 351694 8/1979 Austria .

532569 10/1954 Belgium ..... 164/440

704512 4/1941 Fed. Rep. of Germany .

1508758 12/1970 Fed. Rep. of Germany .

*Primary Examiner*—Kuang Y. Lin

*Attorney, Agent, or Firm*—Brumbaugh, Graves, Donohue & Raymond

[57] ABSTRACT

In a method of introducing a starter bar head of a starter bar into the open ends mould of a horizontal continuous casting plant, the mould is removed from the continuous casting plant and placed vertical. Then the starter bar head separated from the starter bar is threaded into the mould and fixed in its position relative thereto. The mould, together with the starter bar head fixed to it, is installed into the plant. Subsequently, the starter bar head is coupled with the starter bar lying in the strand guide and then the fixation of the starter bar head is undone. In an arrangement for carrying out this method, the starter bar head has a larger longitudinal extension than the secondary cooling apparatus. One end of it projects into the mould cavity and the other end is connectable with the starter bar outside of the secondary cooling apparatus. A fixing element for the starter bar head introduced into the mould is provided.

5 Claims, 2 Drawing Figures

METHOD TO BE CARRIED OUT IN A HORIZONTAL CONTINUOUS CASTING PLANT FOR INTRODUCING A STARTER BAR HEAD OF A STARTER BAR INTO THE OPEN ENDS MOULD OF THE HORIZONTAL CONTINUOUS CASTING PLANT

BACKGROUND OF THE INVENTION

The invention relates to a method of introducing a starter bar head of a starter bar into the open ends mould of a horizontal continuous casting plant as well as to a horizontal continuous casting plant for carrying out the method.

With a horizontal continuous casting plant comprising an open ends mould fastened to a tundish, the introduction of the starter bar into the mould involves problems for several reasons. The mould, which is detachably mounted to the tundish, assumes different positions relative to the stationary strand guide, depending on the position of the tundish, so that the starter bar inserted into the mould via the stationary strand guide is not in exact alignment with the mould cavity. It is necessary to slightly lift or lower the starter bar, in particular the starter bar head, in order to prevent a collision of the starter bar head with the mould side walls. Since the mould is fastened to the tundish, the seal fastened to the starter bar head can no longer be checked after threading-in of the starter bar into the mould. Any damage to this seal can no longer be determined, and there is the danger of a strand breakthrough at the onset of casting, if the starter bar head has pushed against a side wall edge during threading-in thereof into the mould.

Due to the secondary cooling mean following upon the mould in horizontal continuous casting plants, the threading-in procedure of the starter bar head into the mould cannot be observed. Moreover, on account of these aftercoolers, the starter bar head has to be seized relatively far away from the mould for the purpose of lifting and lowering during the threading-in procedure, the difficulties during threading-in thus being further increased.

The invention aims at avoiding these disadvantages and difficulties and has as its object to provide a method of the initially defined kind and a plant for carrying out the method, which enable an easy and safe threading-in of the starter bar head into the mould, a damage to the starter bar head seal as well as to the mould side walls being reliably prevented and a check of the seal of the starter bar head inserted into the mould being feasible.

SUMMARY OF THE INVENTION

This object is achieved according to the invention in that the mould is removed from the continuous casting plant and placed vertical, whereupon the starter bar head separated from the starter bar is threaded into the mould and fixed in its position relative to the mould, that, furthermore, the mould, together with the starter bar head fixed to it, is installed into the continuous casting plant, in particular is fastened to a tundish, and that, subsequently, the starter bar head is coupled with the starter bar lying in the strand guide, whereupon the fixation of the starter bar head is loosened.

With a mould equipped with a secondary cooling means, the secondary cooling means advantageously is removed commonly with the mould for the purpose of introducing the starter bar head.

Suitably, the starter bar head is fixed to the secondary cooling means by means of a pin.

In order to be able to couple the starter bar to the starter bar head in a simple way, without having to exactly align these two parts relative to each other during coupling, the starter bar head is coupled with the starter bar by means of a conical connection pin penetrating these two parts.

A horizontal continuous casting plant for carrying out the method of the invention, comprising a tundish, a open ends mould detachably mounted on the discharge opening and an secondary cooling means including cooling plates following thereupon, and a starter bar head including a seal, is characterized in that the starter bar head has a larger longitudinal extension that the secondary cooling means, one end projecting into the mould cavity and the other end being connectable with the starter bar outside of the secondary cooling means, and wherein a fixing means for the starter bar head introduced into the mould is provided.

BRIEF DESCRIPTION OF THE DRAWINGS

The invention will now be explained in more detail with reference to the accompanying drawing, wherein.

DESCRIPTION OF EXEMPLARY EMBODIMENT

Figure 1:
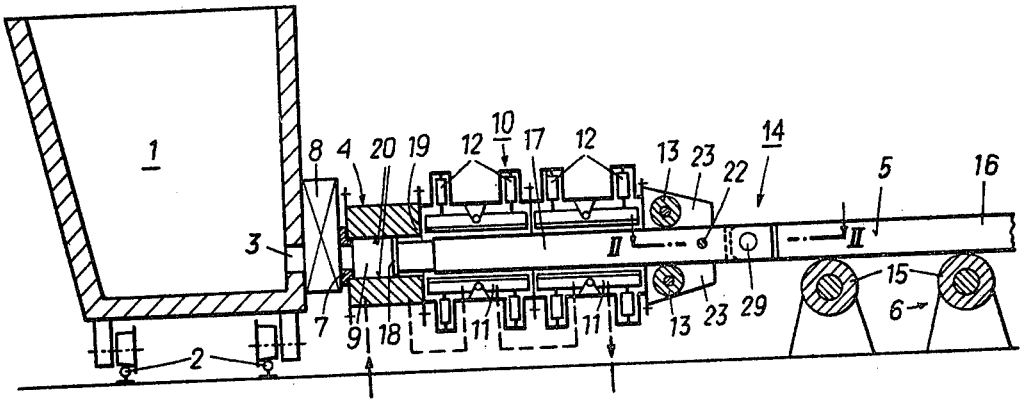
FIG. 1 is a section through a horizontal continuous casting plant in schematic illustration.
Figure 2:
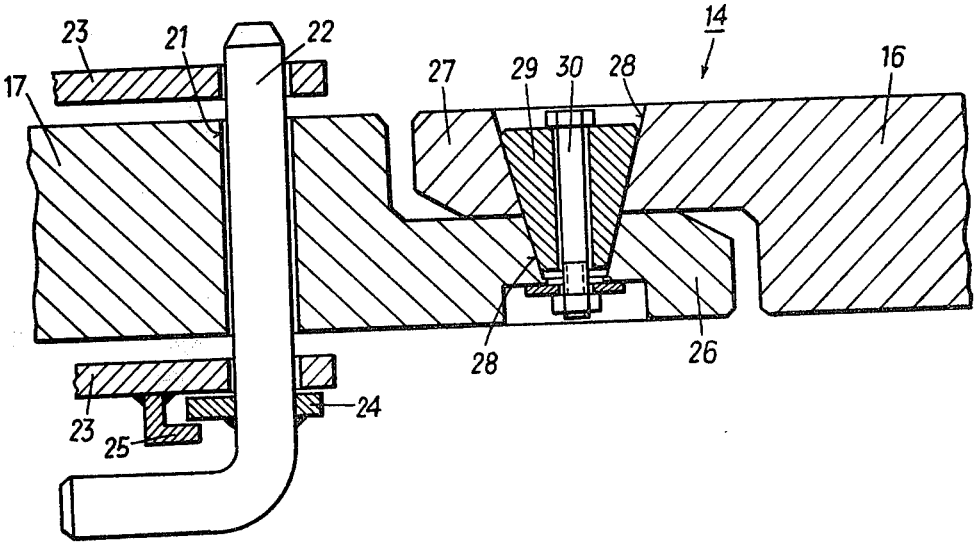
FIG. 2 illustrates a section taken along the line II—II of FIG. 1 on an enlarged scale.

A tundish 1 is movable along rails 2, together with an open ends mould 4 fastened to it in the region of the discharge 3, transversely to the longitudinal direction 5 of the strand guideway 6, the mould 4 thus being easily exchangeable together with the tundish 1. Between the mould 4 and the tundish 1, a sealing body 7 and a slide 8 are provided.

The mould 4 itself comprises a water-cooled part forming the mould cavity 9 proper, to which secondary cooling means 10 including cooling plates 11 are connected, the cooling plates being adjustable to the strand surface by means of pressure medium cylinders 12. On the run-out side end of the second aftercooler 10, rollers 13 are provided, which are not driven and serve to center roughly the strand or the starter bar 14. By 15 the rollers of the strand guide are denoted. The starter bar 14 is composed of a starter rod 16 and a starter bar head 17 detachably fastened to this starter bar rod and provided with a seal 18 on its front end that projects into the mould.

According to the known arrangements, the position of the starter bar head 17 in alignment with the mould cavity 9 has had to be effected by lifting or lowering the starter bar head during threading-in of the starter bar head into the mould (manually or by means of a crane), which constitutes a difficult operation during the course of which collisions of the starter bar head with the edges 19 of the mould side walls 20 are unavoidable.

According to the invention, the starter bar head 17 is detachably fastened to the starter rod 16, the point of separation—with the starter bar head 17 threaded into the mould—lying outside of the secondary cooling means 10, i.e. between the secondary cooling means 10 and the strand guide 6. The starter bar head has a length that is larger than the longitudinal extension of the secondary cooling means 10, thus projecting outwardly through the secondary cooling means.

Furthermore, the starter bar head 17 comprises a means for fixation on the mould 4 and the secondary cooling means 10. In the embodiment illustrated, this means is designed as a hole 21 provided in the starter bar head, through which a pin 22 may be stuck also penetrating plates 23 lying laterally of the starter bar head and carrying the rollers 13. This pin 22 comprises a safety sheet 24 which, in the event of half a turn of the pin, gets out of engagement with a clamp 25 arranged on one of the plates 23.

To connect the starter bar head 17 with the starter rod 16, a conical bore 28 is provided on projections 26, 27 thereof overlapping each other, into which a conical connecting pin 29 is insertable. By inserting this connecting pin 29, the starter bar head 17 and the starter rod 16 are aligned relative to each other. A screw bolt 30 penetrating the conical connecting pin 29 serves to fix the conical connecting pin 29.

The arrangement functions in the following manner:

Before threading the starter bar head 17 into the mould 4, the mould 4 is removed from the continuous casting plant. A removal of the mould is more frequently necessary in horizontal continuous casting plants, since the sealing body 7 as well as the slide 8 constitute highly stressed wear parts, which must be exchanged several times. The mould 4 is removed commonly with the secondary cooling means 10 mounted thereto and pivoted into the vertical position. Then, the starter bar head 17, which has been separated from the starter rod 16 before, is threaded into the mould, which manipulation is easy to carry out, since the starter bar head 17 vertically suspended on a crane can easily be oscillated into a position in alignment with the mould cavity 9. To facilitate this procedure, an introduction funnel aligning the starter bar head may, for instance, be provided, which may be put onto the mould.

During this procedure, the plates 11 of the secondary cooling means 10 are in the retracted position, lifted off the strand, as is illustrated in FIG. 1. After threading in the starter bar head 17, the head is fixed by inserting the pin 22 into the structural unit mould—secondary cooling means 4, 10. Then the mould 4, together with the starter bar head 17 fixed to it, is installed into the continuous casting plant, i.e., mounted to the tundish 1, whereupon the starter rod 16 is coupled with the starter bar head 17 by inserting the conical connecting pin 29. After removal of the pin 22, casting, i.e., extracting the starter bar head 17 out of the mould 4, may be started.

The invention is not limited to the embodiment illustrated, but may be modified in various aspects. The means for fixing the starter bar head to the mould also may be a clamping means; for instance, it is possible to keep the starter bar head in the mould by clamping it between the plates 11 of the secondary cooling means 10.

What I claim is:

1. A method to be carried out in a horizontal continuous casting plant of the type including an open ends mould having an axis extending along the strand extraction direction and a strand guide, for introducing a starter bar head of a starter bar into said mould, which method comprises the steps of removing said mould from said continuous casting plant and placing it in a position in which said axis is oriented vertically, threading said starter bar head, which is separated from said starter bar, into said mould and fixing said starter bar head in its position relative to said mould, repositioning said mould in a position in which said axis is oriented horizontally and installing said mould into said continuous casting plant together with said starter bar head fixed thereon, coupling said starter bar with said starter bar lying in the strand guide, and undoing the fixation of said starter bar head.

2. A method as set forth in claim 1 to be carried out in a horizontal continuous casting plant including a tundish, wherein said mould is fastened to said tundish together with said starter bar head fixed thereon.

3. A method as set forth in claim 1 to be carried out in a horizontal continuous casting plant including a mould equipped with at least one secondary cooling means wherein said secondary cooling means is removed together with said mould for the purpose of introducing said starter bar head.

4. A method as set forth in claim 3, wherein a pin is provided and said starter bar head is fixed to said secondary cooling means by said pin.

5. A method as set forth in claim 1, wherein a conical connecting pin is provided, penetrating said starter bar head and said starter bar, and said starter bar head is coupled with said starter bar by said conical connecting pin.

* * * * *